US005597170A

United States Patent [19]

Le Masson et al.

[11] Patent Number: 5,597,170

[45] Date of Patent: Jan. 28, 1997

[54] ALPINE SKI EQUIPPED WITH A DOUBLE ACTION STIFFENING AND/OR SHOCK ABSORBING DEVICE

[75] Inventors: Jacques Le Masson; Philippe Commier, both of Cran Gevrier, France

[73] Assignee: Salomon S.A., Metz-Tessy, France

[21] Appl. No.: 429,873

[22] Filed: Apr. 27, 1995

[30] Foreign Application Priority Data

May 18, 1994 [FR] France ..... 94 06218

[51] Int. Cl.[6] ..... A63C 5/07

[52] U.S. Cl. ..... 280/602

[58] Field of Search ..... 280/602, 607, 280/609, 610, 616, 617, 618, 11.14

[56] References Cited

U.S. PATENT DOCUMENTS

| | | | |
|---|---|---|---|
| 4,934,669 | 6/1990 | Bourdeau et al. | 280/11.14 |
| 5,251,923 | 10/1993 | Stepanek et al. | 280/602 |
| 5,269,555 | 12/1993 | Ruffinengo | 280/602 |
| 5,280,942 | 1/1994 | Ruffinengo | 280/602 |
| 5,301,976 | 4/1994 | Stepanek et al. | 280/602 |
| 5,332,252 | 7/1994 | Le Masson et al. | 280/602 |
| 5,395,132 | 3/1995 | Abondance et al. | 280/607 |
| 5,417,448 | 5/1995 | Le Masson et al. | 280/602 |

FOREIGN PATENT DOCUMENTS

| | | | |
|---|---|---|---|
| 0521272 | 1/1993 | European Pat. Off. | A63C 5/075 |
| 810762 | 3/1937 | France . | |
| 1118857 | 6/1956 | France . | |
| 1407710 | 12/1965 | France . | |
| 2654635 | 5/1991 | France | A63B 9/082 |
| 2675392 | 10/1992 | France | A63C 5/075 |
| 2678517 | 1/1993 | France | A63C 5/075 |
| 2686798 | 8/1993 | France | A63C 5/00 |
| 2689411 | 10/1993 | France | A63C 5/04 |
| 2694205 | 2/1994 | France | A63C 5/075 |
| 7912699 | 8/1979 | Germany . | |

*Primary Examiner*—Brian L. Johnson
*Assistant Examiner*—Frank Vanaman
*Attorney, Agent, or Firm*—Greenblum & Bernstein P.L.C.

[57] ABSTRACT

The invention relates to a ski equipped with a beam and a device intended to modify the stiffness and/or shock absorption of vibrations. The ski includes (1) at least one elongated element oriented longitudinally with respect to the ski, connected to the ski by a rigid linkage and which includes at least one free end, suited to be displaced longitudinally with respect to the ski when the ski is biased in flexion, and spaced longitudinally from the rigid linkage, and (2) a resistance device connected to the ski that cooperates with the free end in order to resist its displacement, the resistance force of the resistance device that resists the displacement of the free end decreasing between a minimum displacement position and a maximum displacement position. Such a ski maintains its stable qualities in a horizontal position and improves its pivoting and steering characteristics during tight turns.

20 Claims, 6 Drawing Sheets

Fig. 1
PRIOR ART
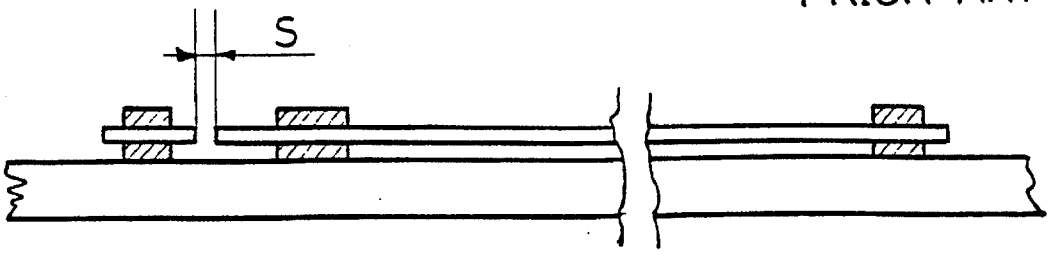
Fig. 2
PRIOR ART
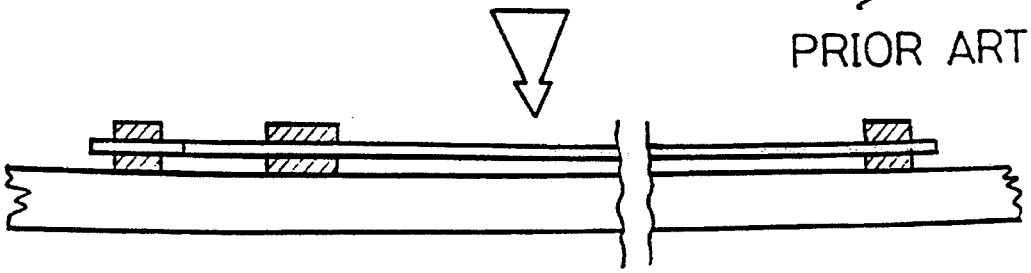
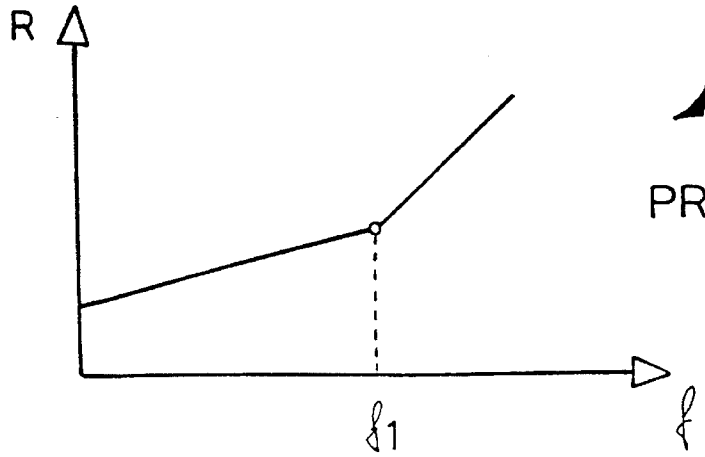
Fig. 3
PRIOR ART 30
3
2
F
6
31
220
S1
21
20
S2
22
221
210
23

30
3
2
F
6
31
220
20
21
221
22
210
222
23

30
2
F1
31
21
P1
P2
22
5

1
5
12
3
2
11
30

ALPINE SKI EQUIPPED WITH A DOUBLE ACTION STIFFENING AND/OR SHOCK ABSORBING DEVICE

BACKGROUND OF THE INVENTION

1. Field of the Invention

The invention relates to an improved ski equipped with a device for modifying the stiffness and/or shock absorption, as a function of the deformation of the ski during use.

2. Discussion of Background and Material Information

The majority of existing shock absorbers or stiffening systems for skis are provided in such a way that the response, in terms of shock absorption and stiffness, is proportional to the bending force exerted on the ski (what the specialist calls "the deformation" of the ski). An example of such a system is disclosed in U.S. Pat. No. 5,251,923, wherein it is illustrated in FIGS. 1–3. The device comprises a rod whose one end is rigidly fixed to a given location on the ski and the other end is translationally free beneath a predetermined bending or flexion f1 of the ski.

In this first configuration (FIG. 1), the ski is a beam having its own rigidity R that increases in a substantially linear fashion as a function of the flexion of the ski. Beyond a certain flexion value f1, the free end cooperates with an abutment system that resists the displacement of the rod whose rigidity is added to that of the ski (FIG. 3). In other words, beyond a flexion value limit f1, the ski becomes much more stiff and directive.

But, the applicant has discovered that a ski equipped with such a device leads to a very controllable and thus very stable device, but on the other hand, one that is difficult to manoeuver. Proceeding from this observation, the applicant has researched solutions that could bring about a better pivoting ability compromise in order to obtain an efficient ski in all high-speed steering situations. In particular, it has been shown that in a horizontal position or during engagement of large radius curves, it is necessary to have a ski that perfectly follows the trajectory with great precision and good stability. It is thus necessary to increase or at least maintain the stiffness and shock absorbing qualities of previous devices.

On the other hand, it has also been discovered that it is necessary to facilitate the deformation of the ski to facilitate reentry into a tight curve in order to have a ski that can be turned just as easily.

Among the devices of the prior art, a stiffening effect proportional to the bending exerted on the ski is found in French Patent Publication No. 2 689 411. In this case, the ski comprises two stiffening elements attached on the base body which cooperate among themselves as to a given bending value so as to increase the overall stiffness of the ski.

In French Patent Publication Nos. 2 675 392, 2 678 517, and 2 694 205 the devices are shock absorbers that also operate according to the principle that when the deformation of the ski increases, the response in terms of shock absorption increases proportionally.

In the state of the art, it is also known to the contrary that in order to facilitate pivoting about the center of gravity of the skier, it is preferable to relieve the ends of the ski from the pressure exerted by the weight of the skier. Such a teaching is described in the prior art documents such as German Patent Publication No. 79 12 699 and French Patent Publication No. 810 762. The invention described in these two documents relates to a ski equipped with an inverted camber base on which a normal camber stiffener is attached. Thus, when the ski is relieved of the weight of the skier, the ends rise under the effect of the base camber and when the skier rests on the ski, the stiffener cancels the base camber and presses the ends against the snow. The disadvantage of these devices resides in the fact that at the moment of turn initiation, any relief of the ends of the ski cannot realistically intervene by reason of the fact that the skier exerts a substantial effort on the ski to avoid any skidding. It is fitting to note that such devices are inefficient and do not respond in terms of a solution to the realities of the operation of a ski on snow.

Finally, in the prior art, applicants are aware of French Patent Publication No. 2 686 798 whose object is an interactive device aiming, conversely, to increase the pressure on the "active" ends of the ski by direct support of the boot on the device. What must be understood by "active" ends are the portions in contact with the snow as opposed to the raised ends that are the shovel and tail.

In the case of the present invention, the boot does not exert any direct effect on the device to modify the distribution of pressure on the snow.

SUMMARY OF THE INVENTION

An object of the present invention is thus to provide a ski equipped with a stiffening and/or shock absorbing device whose effect acts in a manner inversely proportional to the bending exerted on the ski so as to obtain a device that has stability and/or shock absorbing characteristics in a horizontal position and pivoting and snappy characteristics during engagement in tight curves.

For this, the ski according to the invention is equipped with a beam and a device comprising:

- at least one elongated element oriented longitudinally with respect to the ski; connected to the ski by a rigid linkage arrangement and which includes at least one free end, suited to become longitudinally displaced with respect to the ski when the ski is biased in bending, and longitudinally spaced from the rigid linkage arrangement;
- a resistance means connected to the ski, that cooperates with the free end in order to resist its displacement;
- the resistance force of the resistance means that resists the displacement of the free end decreases between a minimum displacement position and a maximum displacement position. Thus, when the ski is slightly biased in bending, i.e., during steering in a horizontal position or in large curves, the stiffening and/or shock absorbing effect is predominant. A stable ski is obtained that perfectly follows its trajectory. In the same way, when the ski is deformed at the start of an even tighter turn, the above-mentioned effect is less substantial, thus leading to the obtainment of a pivoting and perfectly controllable ski.

According to a special embodiment, the resistance means includes two distinct operating conditions as a function of the displacement of the free end with respect to the ski:

- a first condition during which a certain resistance force resists the displacement of the free end beneath a predetermined displacement value and,
- a second condition during which the resistance force that resists the displacement of the free end is zero or at least less than the resistance force of the first condition from and beyond the predetermined displacement value.

According to another embodiment, it is provided that the decrease in the resistance force between the minimum displacement position and the maximum displacement position is progressive.

Preferably, the elongated element is rigidly connected to the ski by its end opposite the free end so that the distance between the rigid linkage means is as far as possible from the resistance means and increases the displacement amplitude of the free end.

In a first embodiment, the free end of the elongated element includes a section increase and cooperates with friction means belonging to the resistance means beneath the predetermined displacement value; the section increase being, at least in part, disengaged from the friction means from and beyond the displacement value so as to enable free sliding of the elongated element.

Advantageously, the friction means are comprised of at least two friction plates made of a material with a high friction coefficient; the resistance means also including a pressure element that compresses the friction plates against the surfaces of the free end.

According to another embodiment, the free end of the elongated element comprises a section increase that cooperates with the first friction means of the resistance means, beneath the predetermined displacement value; then with the second friction means, from and beyond the displacement value; the material chosen to comprise the second friction means having a friction coefficient less than that of the material chosen to comprise the first means.

According to a construction method, the resistance means is a liquid or gaseous fluid shock absorber comprising an impermeable chamber having an internal cavity, a piston connected to the free end and traversing the chamber.

According to a special characteristic, the piston is displaced in at least two portions having different transverse sections; a first portion having a section on this side of the predetermined displacement value and a second portion having a section greater than the section of the first portion from and beyond the first portion.

According to a general characteristic of the invention, the device comprises at least one longitudinal steering means in translation from the elongated element between the free end and the rigid linkage means, to improve its resistance to buckling.

BRIEF DESCRIPTION OF THE DRAWINGS

Other objects, characteristics and advantages of the invention will appear in the following description of special embodiments, made in relation to the attached figures, among which:

FIG. 1 is a partial view of a ski equipped with a stiffening device according to U.S. Pat. No. 5,251,923 of the prior art.

FIG. 2 is a view similar to that of FIG. 1 when the ski is subjected to a specific deflection.

FIG. 3 is a graph illustrating the general stiffness variation R as a function of the deflection undergone by the ski according to the method of the prior art.

DETAILED DESCRIPTION OF THE PREFERRED EMBODIMENTS

Figure 4:
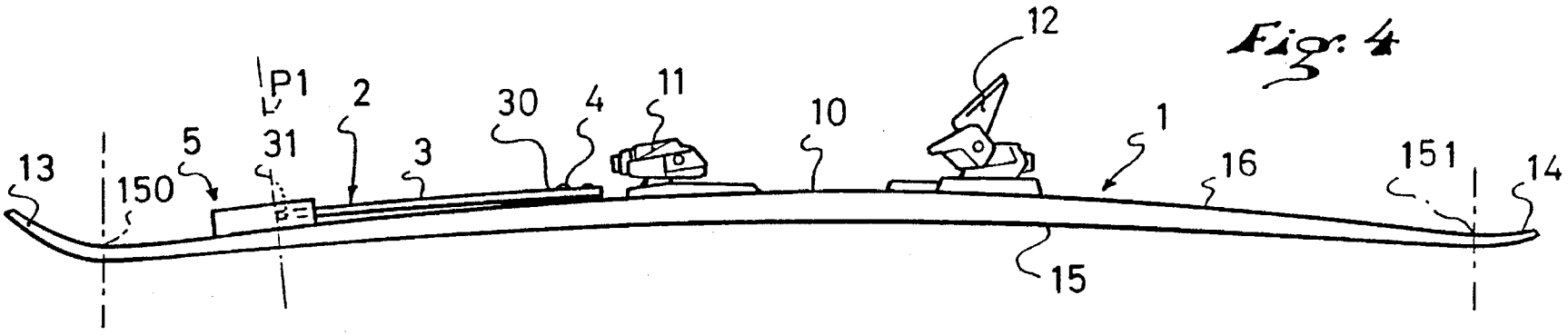
FIG. 4 is a profile view of the ski, at rest, according to a first embodiment of the invention.

The ski of the invention illustrated in FIG. 4 comprising the device is comprised of an elongated beam 1 having its own thickness and width distribution, and thus its own stiffness. It includes a central portion 10, which is also referred to as the binding mounting zone 11, 12, intended to retain the boot on the ski. The front end 13 of beam 1 is raised to form the shovel, whereas the rear end 14 is also raised to form the tail. The beam includes in addition a lower sliding surface 15 and an upper surface 16. It is to be noted that the contact of the lower surface 15 with the snow is done between the front contact point 150 and the rear contact point 151, corresponding respectively to the places where the lower surface begins to rise.

FIG. 4 illustrates a first embodiment of the invention that comprises an attached stiffening or shock absorbing device 2 located at the front of the beam 1, on its upper surface 16. This device comprises an elongated element comprised of a flexible blade 3 having a first fixed end 30 affixed to the upper surface 16 by a rigid linkage means 4 and a second free end 31 that cooperates with a resistance means 5 that resists the relative displacement of the free end 31 with respect to the upper surface 16 of the ski when the ski is biased in flexion.

Figure 4B:
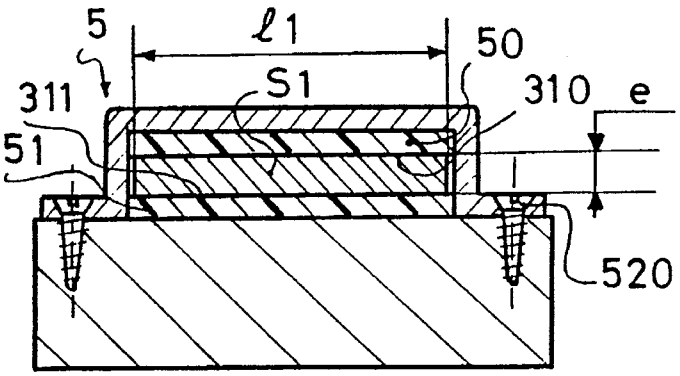
FIG. 4*b* is a sectional view along line I—I of FIG. 4*a*.
Figure 4A:
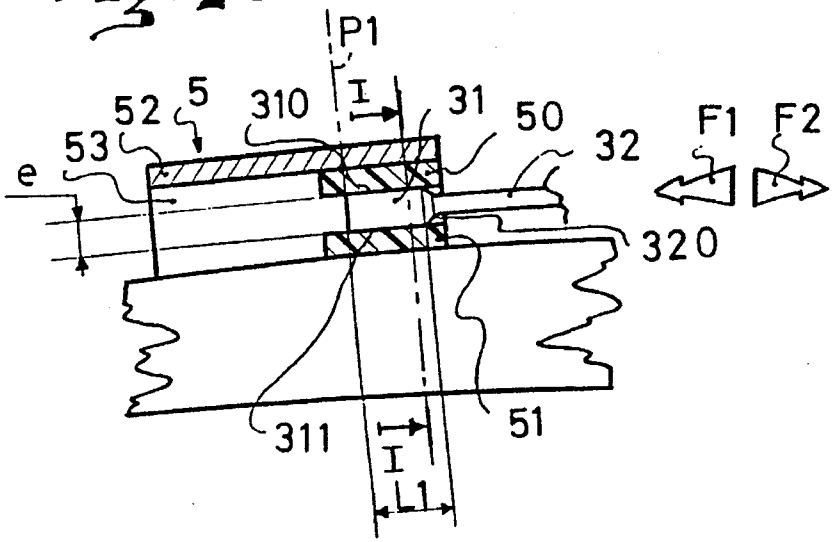
FIG. 4*a* is a detailed view of the device of FIG. 4, in the first operational configuration, i.e., in a minimum displacement position P1.

As shown in FIGS. 4*a* and 4*b*, the resistance means 5 comprises friction means comprised of two friction plates respectively, upper 50 and lower 51, in a material having a high friction coefficient. The resistance means 5 also comprises a support and retention stirrup 52. The friction surfaces of each plate 50, 51 are separated from one another by a certain distance e corresponding substantially to the thickness of the free end 31 having a cross section S1 along a first length L1 and along a width l1. Thus the upper surface 310 and the lower surface 311 of the free end are in contact with the surface of the upper 50 and lower 51 friction plates, respectively, within a certain displacement value d1 of the blade.

The friction material can be comprised, for example, of a layer of thermoplastic rubber or of a visco-elastic material. Thus, a first layer is glued on the upper surface 16 of the ski and a second layer is glued beneath the central wall of the retention stirrup which has the form of an Ω (omega) and which is affixed by screws 520. The front end 31 of the blade can thus become displaced along directions F1 and F2 between the friction plates 50, 51. So that there is a dissipation of energy of the longitudinal movements along F1 and F2, the stirrup maintains pressure and pinches the blade between the two layers.

Of course, the intensity or the tightening force of the bending blade between the two friction layers by the stirrup can be adjustable as a function of the shock absorption that one wants to obtain.

Similarly, the longitudinal position of the resistance means 5 can be adjusted easily by the removable linkage provided between the stirrup 52 and the upper surface of the ski 16.

Figure 5:
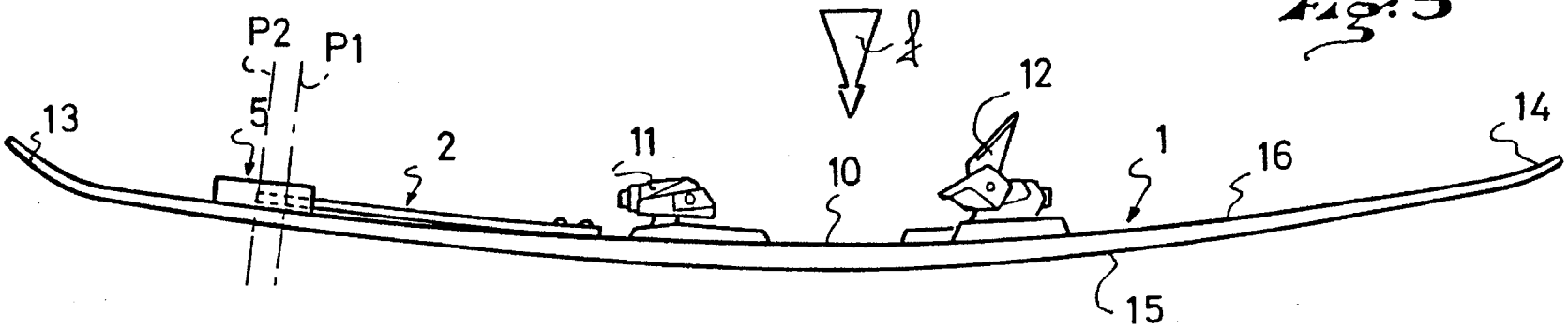
FIG. 5 is a profile view of the ski according to the first embodiment of the invention, when it is biased in flexion and subjected to a certain deflection, in a maximum displacement position P2.
Figure 5B:
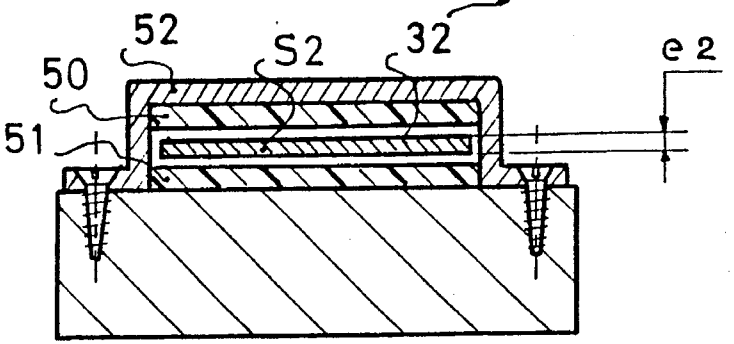
FIG. 5*b* is a sectional view along line II—II of FIG. 5*a*.
Figure 5A:
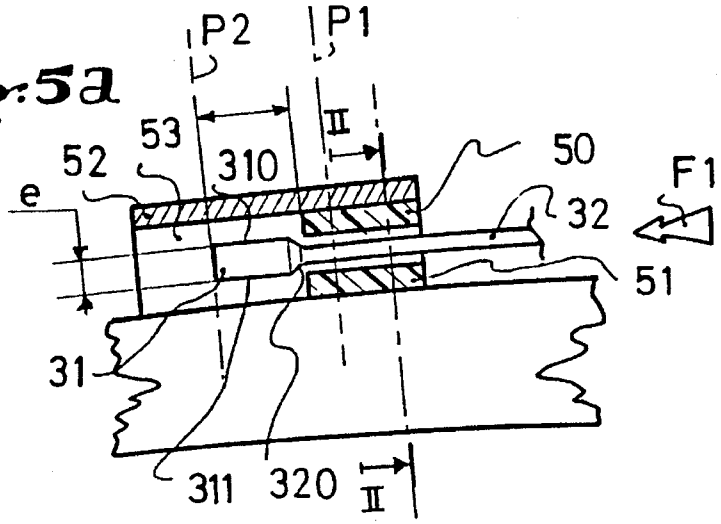
FIG. 5*a* is a detailed view of the device of FIG. 5.

FIGS. 5, 5*a* and 5*b* show the ski equipped with a device in a second operational configuration, i.e., when a maximum displacement threshold of the free end is attained in the F1 direction as a function of the downwardly directed flexion force f exerted on the beam 1, as shown in FIG. 5. Thus, the free section end S1 is disengaged from the friction plates 50, 51 and is engaged in a cavity 53 having an increased section in which the surfaces 310, 311 of the free end are no longer subjected to friction. The blade comprises, on the other hand, a narrow portion 32 cross section S2 that can freely slide between the plates 50, 51 without friction (distance e2 being less than (distance e, especially). In this configuration, the resistance means 5 no longer provides a resistance force against the free end of the blade. This results in the ski becoming easier to steer.

Figure 6:
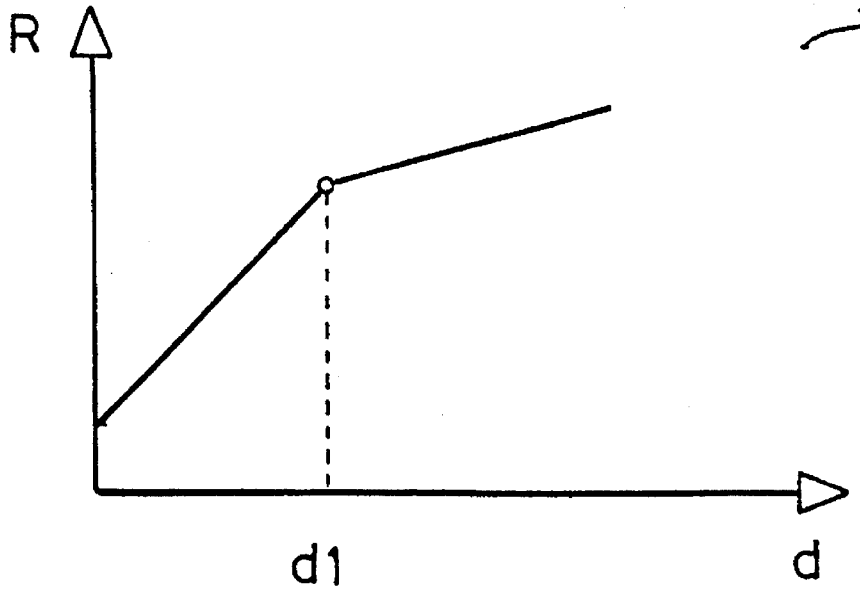
FIG. 6 is a graph illustrating the stiffness variation R as a function of the displacement d of the free end of the blade on the ski.

FIG. 6 illustrates the run of the curve showing the variation of the overall stiffness R of the ski as a function of the displacement d of the free end, itself proportional to the deformation of the ski.

Preferably, as shown in FIG. 5*a*, the blade includes a transition zone 320 between the free end 31 having a thick cross section S1 and the adjacent narrowed portion of the blade 3 having a thinner cross section S2, in which the section reduction occurs progressively in order to facilitate the blade's return to position when the ski resumes its initial shape.

Figure 7:
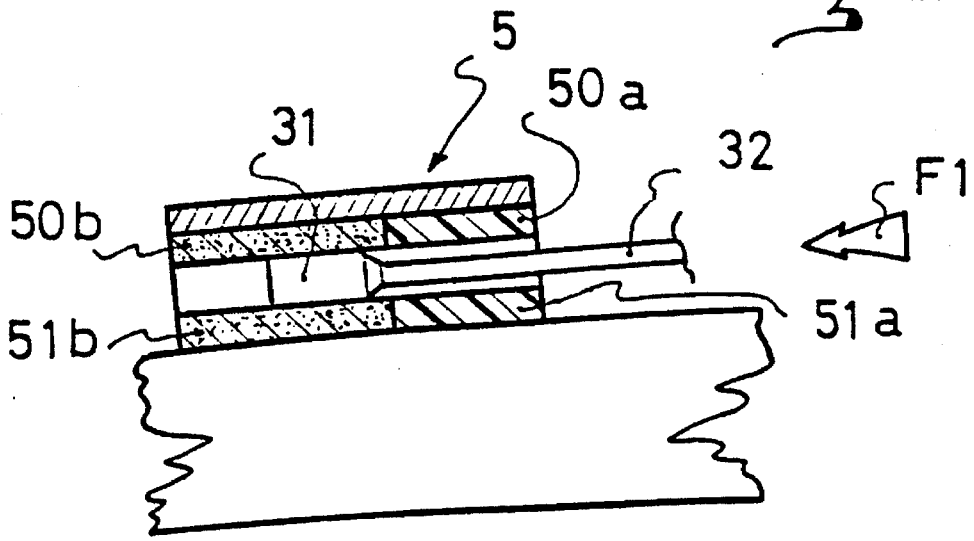
FIG. 7 is a view similar to the view in FIG. 5*a* according to a variation.

FIG. 7 illustrates a variation of the preceding embodiment.

The blade also comprises a free end 31 having an increased section followed by a narrowed portion 32. The free end 31 cooperates with a resistance means 5 that comprises, first a series of plates 50*a*, 51*a* selected of a material having a specific friction coefficient and, then, a second series of plates 50*b*, 51*b*, adjacent to the first series, and selected a material having a friction coefficient less than the material of the first. Thus, as soon as the free end 31 which is displaced in the F1 direction reaches the area of the second series of plates, the resistance force that resists the displacement of the blade decreases. Therefore, as in the embodiment of FIGS. 5, 5*a*, and 5*b*, the decrease in the friction force results from the contact surface of the free end 31 being delimited by the narrowed transverse section of the portion of the blade 3 immediately adjacent to the free end. However, whereas the friction force in the former embodiment is reduced to essentially zero, since the narrowed portion 32 (see FIG. 5*a*) does not contact the friction plates 50, 51, in FIG. 7, although the narrowed portion 32 still fails to contact the friction plates 50*a*, 51*a*, the friction force is not reduced to zero since the free end 31 contacts the friction plates 50*b*, 51*b*.

Figure 8:
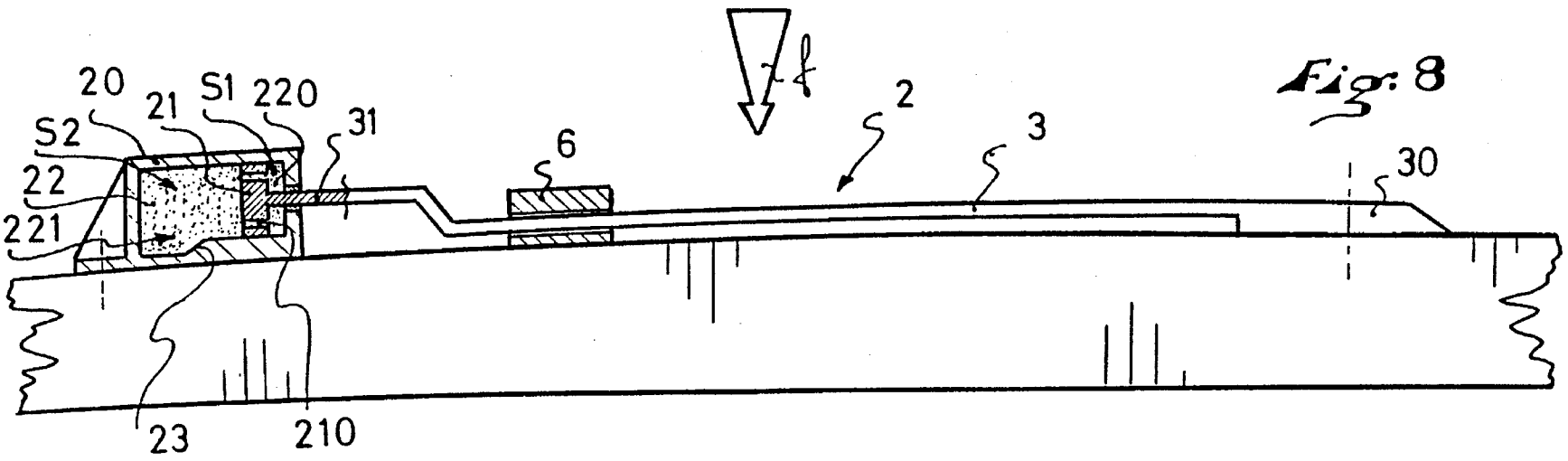
FIG. 8 is a partial view of a ski equipped with a hydraulic or pneumatic shock absorbing device according to a second embodiment of the invention.
Figure 9:
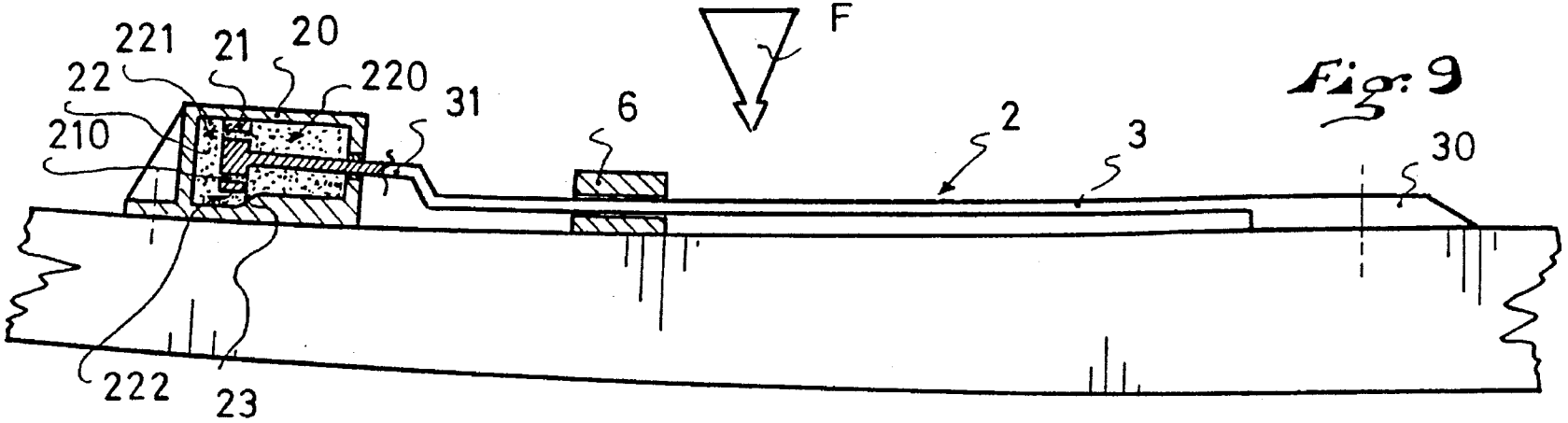
FIG. 9 is partial view similar to the view of FIG. 7 as of a certain displacement value of the blade on the ski.
Figure 10:
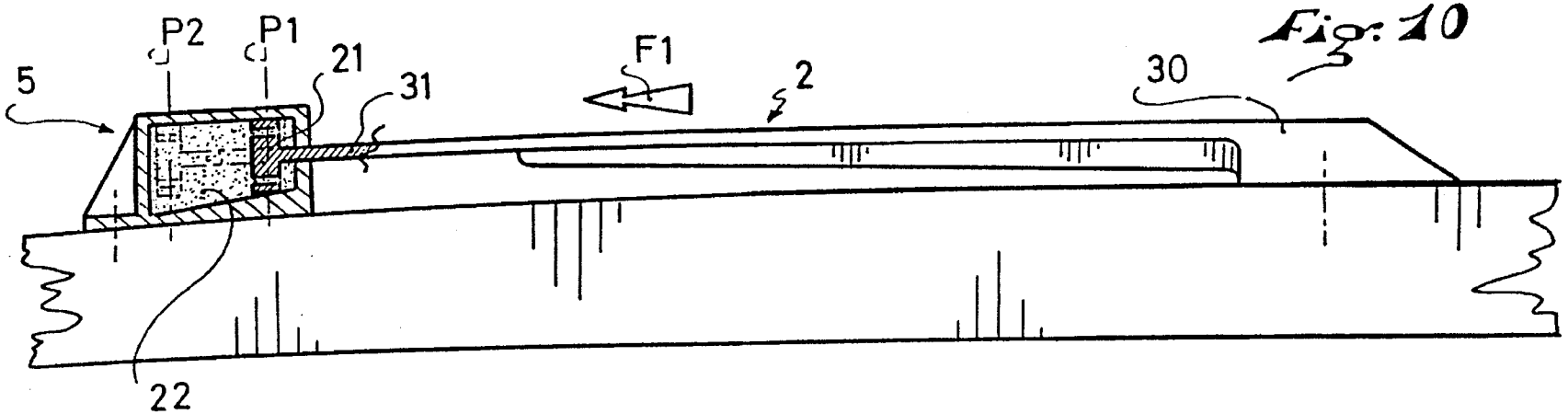
FIG. 10 is a view similar to the view of FIG. 8 according to a variation.

FIGS. 8 to 10 illustrate another embodiment of the invention in which the resistance means of a friction type is replaced by a liquid or gaseous fluid shock absorber. In this case, the shock absorber includes at least two distinct operating conditions in the case of FIGS. 8 and 9 and a sole progressive changing condition in the case of FIG. 10.

The shock absorbing device 2 includes a blade 3 also having a fixed end 30 and a free end 31. The free end becomes engaged in an impermeable chamber 20 and ends in a piston 21. The chamber comprises an internal cavity 22 which is divided by the piston into two volumes 220, 221 that are variable as a function of the displacement of the piston in the cavity.

Piston 21 is traversed by one or several orifices 210 enabling the passage of the liquid fluid from the first volume 220 to the second 221 and vice versa.

The internal cavity 22 has at least two portions, viz., a first portion having a narrowed transverse section S1 followed by a second portion having an increased transverse section S2. At the beginning of the path, i.e., for a slight displacement of the free end 31 of the blade 3, the piston is displaced in the first portion having a transverse section S1, corresponding substantially to that of the piston. In this case, the fluid passes from the second volume 221 to the first volume 220 through the passage orifices provided 210. A true shock absorbing effect is created which is such that the more the displacement is abrupt and harsh, the more the mixture of gas and liquid exerts a shock absorbing effect on the piston by reason of inertia when it traverses the orifices. By pursuing the path of the piston 20 in the increased transverse section S2, as of the expansion surface or ramp 23 achieved by the piston, the fluid (liquid or gas) can then flow freely by means of the increased section created 222 from one volume to the other, such that the shock absorbing effect becomes greatly diminished as of a certain displacement.

For the return of the piston, it is the elasticity of the ski itself which is exerted in the manner of a return spring enabling the device to resume its initial configuration.

To avoid any risk of the blade buckling and better sliding on the inside of the resistance means 5, one or several guiding means 6 can be provided, located between the resistance means and the fixed end 30. This means is all the more efficient because the ski must undergo strong flexions in certain terrain conditions or for certain disciplines.

In the particular case of FIG. 10, a progressive decrease of the shock absorbing effect is obtained, which translates into a decrease in the resistance force that resists the displacement of the piston 21 between the minimum position P1 and the maximum position P2. Provided for this is a progressive increase in the transverse section of the internal cavity 22 in the F1 displacement direction of the blade when a ski is biased in flexion.

The rigid linkage means 4 enabling the affixation of the blade on the ski, in all the figures previously described, can be a detachable means of the screw, rivet, or other type, or even an non-removable means such as gluing or vibration welding, for example.

The elongated element 2 can take any desired shape. It can consist of a flexible blade in the form of an elongated planar plate or, conversely, a section having one or several longitudinal ribs enabling an increase in its resistance to buckling. It can be obtained by injection of a charged plastic material. In the case of using high quality materials such as steel or carbon, the blade can be replaced by a simple cylindrical or rectangular rod having a slight section, in order not to exceed compression values that are too substantial.

The device can be located on the ski in any place, other than at the front.

Figure 11:
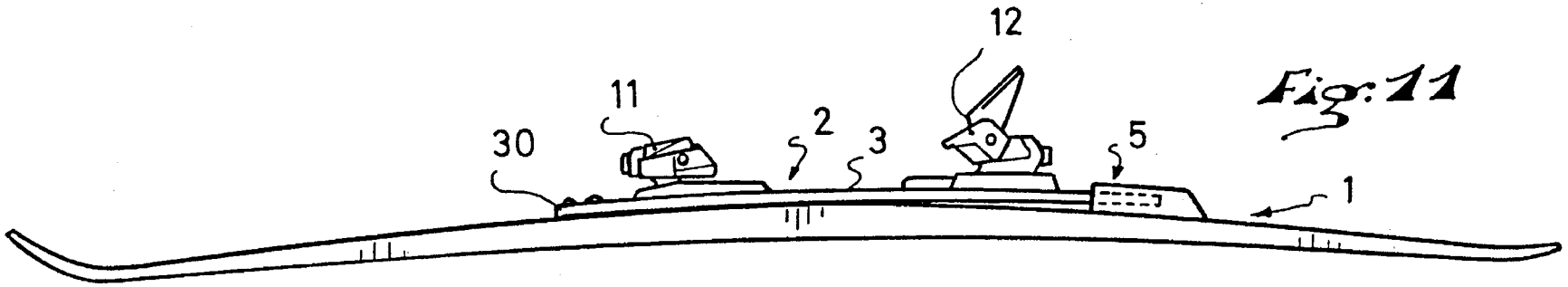
FIG. 11 is a view similar to the view of FIG. 1 in the case where the device serves as support to the bindings.

In an advantageous manner, it can also serve as a platform to support the bindings as illustrated in FIG. 11. In this case, the blade 2 must have a width sufficient to receive the bindings 11, 12 that are directly affixed to it to enable a normal operation of the device.

Of course, the invention is not limited to the embodiments described and represented as examples, but it also comprises all technical equivalents as well as their combinations. Thus, the specialist can envision the replacement of the resistance means by other equivalent means without at all leaving the scope of the invention.

The instant application is based upon French patent application 94.06218 of May 18, 1994, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A ski including a beam and a device for at lease one of modifying stiffness and shock absorption of vibrations, said ski comprising:

at least one elongated element positioned longitudinally with respect to the ski, said elongated element having at least one free end portion, said free end portion being longitudinally displaceable with respect to the ski in response to flexion of the ski from a resting position to a maximum flexed position;

means for rigidly affixing a further portion of said elongated element to the ski, said further portion of said elongated element being spaced from said free end portion of said elongated element;

a resistance device affixed to the ski, said resistance device having a structure that is operatively connected to said free end portion of said elongated element to resist longitudinal displacement of said free end portion of said elongated element with respect to the ski, by producing a resisting force of a predeterminate magnitude during flexion of the ski from said resting position, and a resisting force of a magnitude less than said predeterminate magnitude during flexion at said maximum flexed position of the ski, regardless of the direction of said longitudinal displacement of said elongated element with respect to the ski, said structure including a friction surface that engages said free end portion of said elongated element.

2. A ski according to claim 1, wherein:

said resistance device comprises two distinct operating conditions as a function of the displacement of said free end with respect to the ski, said two conditions comprising:

a first condition during which said predeterminate resisting force resists displacement of said free end within a predetermined displacement value; and a second condition during which said lesser magnitude resisting force has a magnitude equal to one of zero and less than said predeterminate resisting force of the first condition beyond said predetermined displacement value.

3. A ski according to claim 2, wherein:

said free end portion of said elongated element comprises an increased transverse section which cooperates with said friction surface within said predetermined displacement value;

said increased transverse section being, at least partially, disengaged from said friction surface beyond said displacement value so as to enable free sliding of said elongated element.

4. A ski according to claim 3, wherein:

said structure of said resistance device comprises at least two friction plates made of a material having a high friction coefficient;

said resistance device also comprises a pressure element that compresses the friction plates against surfaces of the free end portion of said elongated element.

5. A ski according to claim 2, wherein:

said friction surface of said structure of said resistance device comprises a first friction surface, said structure of said resistance device further comprising a second friction surface;

said free end portion of said elongated element has an increased transverse section that cooperates with said first friction surface, within said predetermined displacement value and with said second friction surface beyond said displacement value; said second friction surface comprising a surface of a material having a friction coefficient less than a friction coefficient of a material of which said first surface is comprised.

6. A ski according to claim 1 wherein:

said resistance device further comprises at least one longitudinal guiding means positioned between said free end portion and said rigidly affixed portion of said elongated element for guiding said elongated element in translation.

7. A ski according to claim 1 wherein:

said rigidly affixed portion is located at an end portion of said elongated element opposite said free end portion.

8. A ski according to claim 1, wherein:

the elongated element comprises a flexible blade having a rectangular transverse section.

9. A ski including a beam and a device for at least one of modifying stiffness and shock absorption of vibrations, said ski comprising:

at least one elongated element positioned longitudinally with respect to the ski, said elongated element having at least one free end portion, said free end portion being longitudinally displaceable with respect to the ski in response to flexion of the ski from a resting position to a maximum flexed position in response to a downward force directed at a central portion of the ski;

means for rigidly affixing a further portion of said elongated element to the ski, said further portion of said elongated element being spaced from said free end portion of said elongated element;

a resistance device affixed to the ski, said resistance device having a structure that is operatively connected to said free end portion of said elongated element to resist longitudinal displacement of said free end portion of said elongated element with respect to the ski, by producing a resisting force of a predeterminate magnitude during flexion of the ski from said resting position toward said maximum flexed position, and a resisting force of a magnitude less than said predeterminate magnitude during flexion at said maximum flexed position of the ski.

10. A ski according to claim 9, wherein:

said resistance device is a liquid or gaseous fluid shock absorber comprising an impermeable chamber having an internal cavity, a piston connected to said free end portion of said elongated element and traversing said chamber.

11. A ski according to claim 10 wherein:

said piston is traversed by at least one orifice enabling of the fluid to pass from a first volume into a second volume and vice versa.

12. A ski according to claim 10, wherein:

said piston is positioned to become displaced in at least two portions of said chamber having different transverse sections, said portions comprising a first portion having a first transverse section within which said piston is displaceable a predeterminate extent during flexions of the ski of a first magnitude and a second portion of said chamber having a transverse section greater than said transverse section of said first portion within which said piston is displaceable beyond said predeterminate extent.

13. A ski according to claim 12, wherein:

said two portions of said chamber having different transverse sections are separated by an expansion ramp.

14. A ski according to claim 13, wherein:

the resistance means is a liquid or gaseous fluid shock absorber comprising an impermeable chamber having an internal cavity, a piston connected to said free end and traversing said chamber, said internal cavity having a progressive transverse section increase in a predeterminate displacement direction of the elongated element when the ski is biased in flexion.

15. A ski according to claim 9, wherein:

said structure of said resistance device is operatively connected to said free end portion of said elongated element to produce a progressive decrease of resistance force between said resting position and said maximum flexed position.

16. A device for at least one of modifying stiffness and for absorbing shock of a ski, said device comprising:

at least one elongated element positioned longitudinally with respect to the ski, said elongated element having at least one free end portion, said free end portion being longitudinally displaceable with respect to the ski in response to flexion of the ski from a resting position to a maximum flexed position;

means for rigidly affixing a further portion of said elongated element to the ski, said further portion of said elongated element being spaced from said free end portion of said elongated element; and a resistance device adapted to be affixed to the ski, said resistance device having a structure that is operatively connected to said free end portion of said elongated element to resist longitudinal displacement of said free end portion of said elongated element with respect to the ski, by producing a resisting force of a predeterminate magnitude during flexion of the ski from said resting position, and a resisting force of a magnitude less than said predeterminate magnitude during flexion at said maximum flexed position of the ski, regardless of the direction of said longitudinal displacement of said elongated element with respect to the ski, said structure including a friction surface that engages said free end portion of said elongated element.

17. A device according to claim 16, wherein:

said elongated element has a portion immediately adjacent said free end portion; and said immediately adjacent portion of said elongated element has a transverse section decreased in a certain dimension compared to a transverse section of said free end portion.

18. A device according to claim 17, wherein:

engagement between said friction surface of said structure of said resistance device and said elongated element is delimited by said decreased dimension of said immediately adjacent portion of said elongated element which produces said resisting force of a lesser magnitude.

19. A device for at least one of modifying stiffness and for absorbing shock of a ski, said device comprising:

at least one elongated element positioned longitudinally with respect to the ski, said elongated element having at least one free end portion, said free end portion being longitudinally displaceable with respect to the ski in response to flexion of the ski from a resting position to a maximum flexed position in response to a downward force directed at a central portion of the ski;

means for rigidly affixing a further portion of said elongated element to the ski, said further portion of said elongated element being spaced from said free end portion of said elongated element;

a resistance device adapted to be affixed to the ski, said resistance device having a structure that is operatively connected to said free end portion of said elongated element to resist longitudinal displacement of said free end portion of said elongated element with respect to the ski, by producing a resisting force of a predeterminate magnitude during flexion of the ski from said resting position toward said maximum flexed position, and a resisting force of a magnitude less than said predeterminate magnitude during flexion at said maximum flexed position of the ski.

20. A device according to claim 19, wherein:

said elongated element has a portion immediately adjacent said free end portion; and said free end portion of said elongated element has a transverse section increased in a certain dimension compared to a transverse section of said immediately adjacent portion.

* * * * *